US005695097A

United States Patent [19]

Röllinghoff

[11] Patent Number: 5,695,097

[45] Date of Patent: Dec. 9, 1997

[54] DEVICE FOR CONTAINING AND DISPENSING BULK MATERIALS

[75] Inventor: Dirk Röllinghoff, Hagen, Germany

[73] Assignee: Weberit-Werke Dräbing GmbH, Oberlahr, Germany

[21] Appl. No.: 511,292

[22] Filed: Aug. 4, 1995

[30] Foreign Application Priority Data

Aug. 4, 1994 [DE] Germany ..... 44 27 536.6

[51] Int. Cl.[6] ..... B65D 47/00; B67D 3/00

[52] U.S. Cl. ..... 222/531; 222/556

[58] Field of Search ..... 222/531, 532, 222/556

[56] References Cited

U.S. PATENT DOCUMENTS

| | | | |
|---|---|---|---|
| 2,361,958 | 11/1944 | Nyden | 222/556 |
| 3,144,180 | 8/1964 | Phillipps et al. | 222/531 X |
| 3,303,971 | 2/1967 | Stevens, Jr. | 222/532 X |
| 3,515,314 | 6/1970 | Waterman | 222/556 X |
| 3,659,756 | 5/1972 | Lancaster | 222/556 X |
| 3,773,232 | 11/1973 | Hidding | 222/556 X |
| 4,984,720 | 1/1991 | Groya et al. | 222/531 |
| 5,022,566 | 6/1991 | Song et al. | 222/556 X |
| 5,054,662 | 10/1991 | Santagiuliana | 222/556 X |
| 5,156,302 | 10/1992 | Kuitems | 222/556 X |
| 5,192,005 | 3/1993 | Zimmerman | 222/556 Z |
| 5,193,722 | 3/1993 | Groya et al. | 222/556 X |

*Primary Examiner*—Kevin P. Shaver
*Attorney, Agent, or Firm*—Friedrich Kueffner

[57] ABSTRACT

A device for containing and dispensing materials, particularly pourable bulk materials, such as, foodstuffs, includes a cup-shaped container of synthetic material with a closure ring connected to the container. The closure ring has two recesses arranged on oppositely located sides for receiving pins of a cover which is mounted in an opening of the closure ring so as to be pivotable about a common axis formed by the pins. The cover includes an upper wall and a circumferentially extending collar extending towards the inside of the container. The collar has at least one dispensing opening which is released when the cover is in a pivoted position. The outer shape of the cover and the shape of the opening of the closure ring have the shape of a section of a laterally flattened body of rotation. The cover is pivotally guided in the opening of the closure ring in a positively engaging and sealing manner. If necessary, the cover can be pivoted to a position in which the opening of the closure ring is almost completely released.

5 Claims, 2 Drawing Sheets

FIG. 4
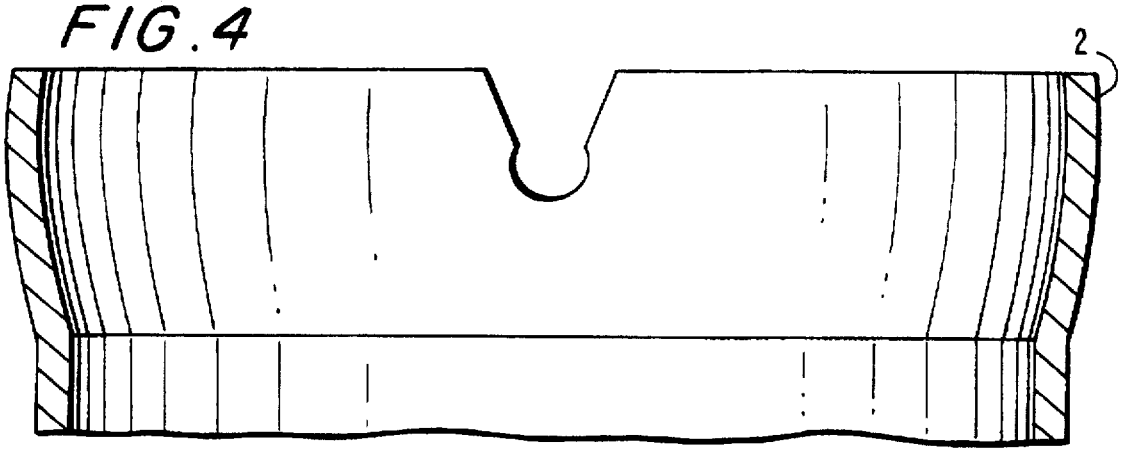
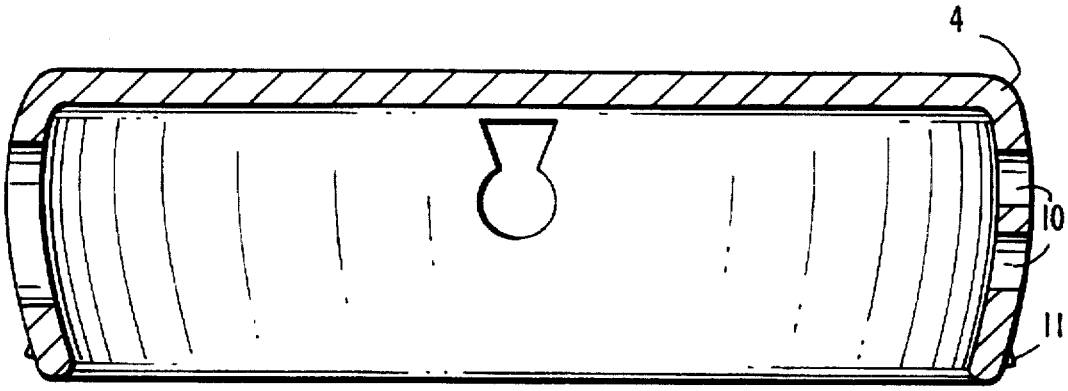
FIG. 5
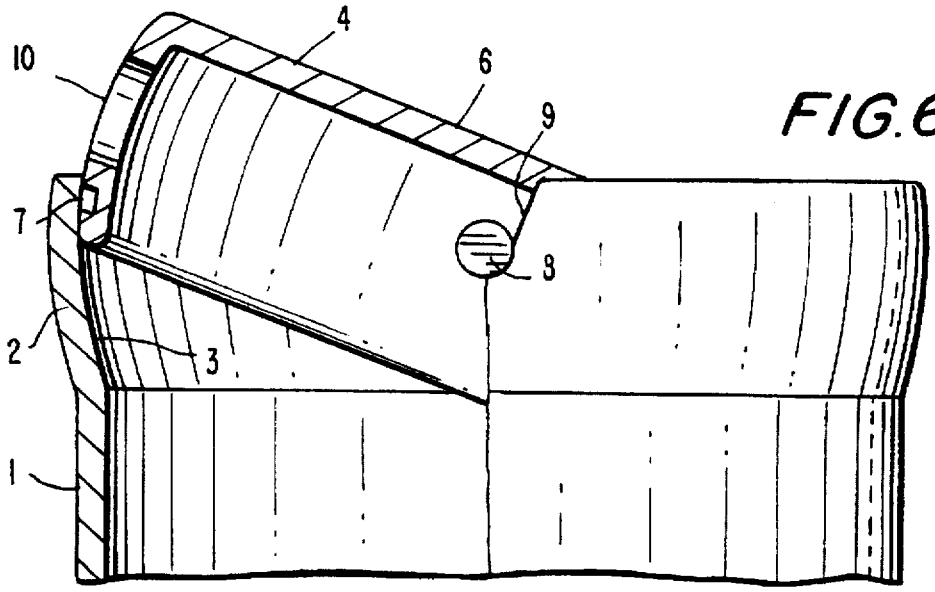
FIG. 6

DEVICE FOR CONTAINING AND DISPENSING BULK MATERIALS

BACKGROUND OF THE INVENTION

1. Field of the Invention

The present invention relates to a device for containing and dispensing materials, particularly pourable bulk materials, such as, foodstuffs. The device includes a cup-shaped container of synthetic material with a closure ring connected to the container. The closure ring has two recesses arranged on oppositely located sides for receiving pins of a cover which is mounted in an opening of the closure ring so as to be pivotable about a common axis formed by the pins. The cover includes an upper wall and a circumferentially extending collar extending towards the inside of the container. The collar has at least one dispensing opening which is released when the cover is in a pivoted position.

2. Description of the Related Art

Devices for containing and dispensing pourable materials, for example, granular or pulverous foodstuffs, are known in the art. These devices are composed of a cup-shaped container of a suitable material, for example, synthetic material. A special closure ring is formed in the upper portion of the container. The closure ring can receive a cover. A rotatable disk is placed in the cover, wherein the disk may have various dispensing openings which can be placed in alignment with a dispensing opening provided in the cover. The disk also serves to close the dispensing opening in the cover. For rotating the disk, it is always necessary to use two hands; one hand holds the container and the other hand rotates the disk into the desired position. This device has the disadvantage that it is always constructed of three parts and can normally not be refilled.

Also known in the art are devices for containing and dispensing liquid sunscreens. These devices are composed of a bottle-like container and a cap-like closure ring which is screwed onto the container. A cover is arranged in the closure ring, wherein the cover has the shape of a spherical layer or a circular disk. The cover can be moved into a pivoted position through the use of two legs or two pins. The cover is composed of an upper wall which covers an opening of the closure ring and a downwardly directed collar attached to the wall. The collar has a dispensing opening. An intermediate wall is provided in the closure ring underneath the cover. The intermediate wall has a sleeve-shaped passage opening which can be closed by the cover when the cover is in its normal position. In a pivoted position of the cover, the passage opening is released and a connection to the dispensing opening is effected as a result. Accordingly, liquid sunscreen can be dispensed in the pivoted position of the cover. It is considered a disadvantage in this device that the entire intermediate space between the intermediate wall and the cover must be filled out with sunscreen before the sunscreen emerges from the dispensing opening. Because of the fact that the end face of the sleeve-shaped passage opening is closed directly by the cover, a special sealing means between the cover and the opening of the closure ring is not required. It is never possible to refill the container through such a cover. Also, the size of the dispensing opening cannot be adjusted.

SUMMARY OF THE INVENTION

Therefore, it is the primary object of the present invention to provide a device for containing and dispensing materials, particularly pourable bulk materials, such as, foodstuffs, wherein a single-handed operation of the device is possible, wherein variable dispensing openings can be achieved, wherein the container can be refilled through the cover received in the opening of the closure ring, and wherein, depending on the type of use, the device is composed of only two components.

In accordance with the present invention, in a device of the above-described type, the outer shape of the cover and the shape of the opening of the closure ring have the shape of a section of a laterally flattened body of rotation. The cover is pivotally guided in the opening of the closure ring in a positively engaging and sealing manner. If necessary, the cover can be pivoted to a position in which the opening of the closure ring is almost completely released.

The device according to the present invention may be composed of only two components and can be operated with one hand. The device is particularly suitable for containing foodstuffs which may lose their aroma and/or foodstuffs which are sensitive with respect to moisture. The large pivoting range of the cover makes it possible to fill or refill the container through the opening in the closure ring. This makes it possible to save valuable raw materials because a refill package may be composed of a simple bag which is tight with respect to aroma and/or moisture and can be stored and discarded without requiring a large amount of space.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 4 is a partial view of a closure ring of the device;

FIG. 5 is a sectional view of a cover of the device; and

FIG. 6 is a side view, partially in section, similar to FIG. 3, showing the device with the cover in another dispensing position.

DESCRIPTION OF THE PREFERRED EMBODIMENTS

Figure 1:
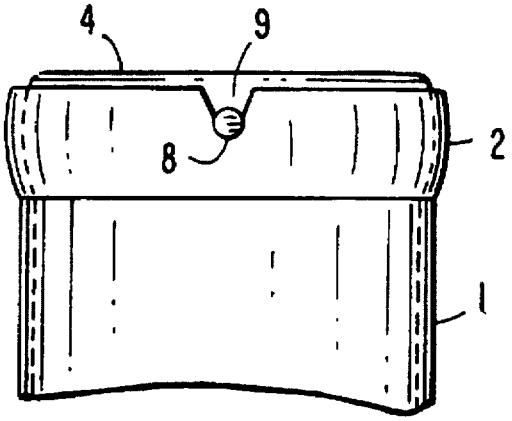
FIG. 1 is a partial side view of a device according to the present invention.
Figure 2:
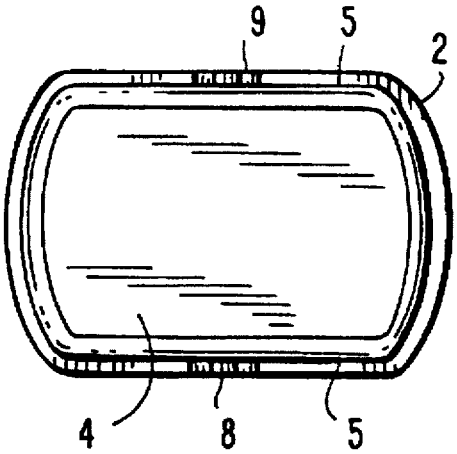
FIG. 2 is a top view of the device of FIG. 1.
Figure 3:
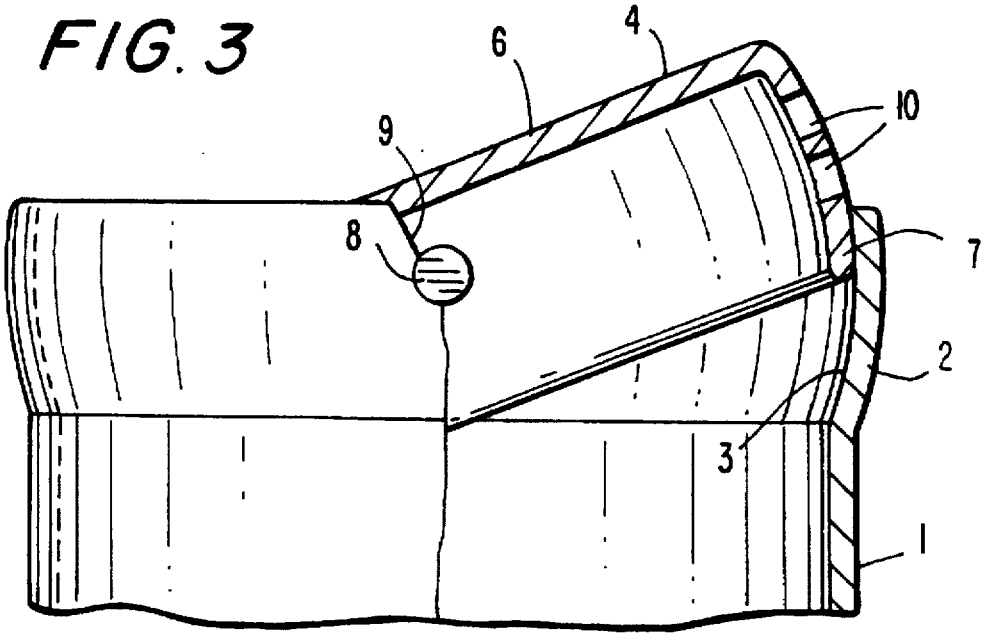
FIG. 3 is another side view, on a larger scale and partially in section, showing the device with the cover in its dispensing position.

FIGS. 1–3 of the drawing show the device according to the present invention for containing and dispensing pourable bulk materials, such as, spices which are sensitive to moisture or loss of aroma. The device is composed of a container 1 of, for example, synthetic material, such as, polypropylene. The container 1 has a circular cross-section which is flattened on two sides. The upper portion of the container 1 is integrally connected to a closure ring 2. However, the closure ring 2 may also be manufactured separately from the container 1 and may be connected to the container 1 by a clamp connection or screw connection. This is the case, for example, when the container 1 is of glass and the closure ring 2 is clamped to the container 1 by means of a beaded or bent edge. In that case, the closure ring 2 is also of synthetic material. However, other materials are also possible.

The closure ring 2 has a specially shaped opening 3. A cover 4 is placed in the opening 3. In the illustrated embodiment, the cover 4 has the shape of a spherical layer which is provided with oppositely located flattened sides 5 in such a way that the cross-section of the cover 4 coincides with the cross-section of the container 1. The shape of the opening 3 in the closure ring 2 conforms to this shape of the cover 4 and is selected in such a way that the inner wall surface of the opening 3 rests sealingly against the outer surface of the cover 4.

The cover 4 is composed of an upper wall 6 which closes the opening 3. A downwardly extending collar 7 is attached to the wall 6. Consequently, the cover 6 has a cap-shaped cross-section. In the illustrated embodiment, a pin 8 each is provided on the flattened sides 5 of the cover 4. The pins 8 form a pivot axis for the cover 4. As seen in cross-section, the outer surface of the cover 4 extends on a circular line, wherein the center of the circular line is the axis of the pins 8.

A recess 9 is provided in each of the flattened sides 5 of the closure ring 2. The recess 9 conically widens toward the upper rim of the closure ring 2 and is open at the top. The cross-section of this opening 9 is selected in such a way that, after overcoming a slight resistance, one of the pins 8 is received in a snapping or locking manner, so that the two pins 8 are secured in the two recesses 9. It is also possible to provide the pins 8 on the closure ring 2 and the recesses 9 in the collar 7 of the cover 4. However, in that case, the opening 9 is open toward the lower end of the collar 7.

This configuration of the cover 4 and the opening 3 in the closure ring 2 and the manner of mounting the pins 8 in the recesses 9 make it possible that the cover 4 can be pivoted about an angle of 360°. However, this rotation by 360° is normally not required. The maximum required pivoting angle of the cover 4 is 90°. When the cover 4 is pivoted from its normal position into a position after a pivoting movement of 90°, a large portion of the cross-section of the opening 3 is released, so that the container 1 can be filled and particularly be refilled even when the cover 4 is mounted on the container 1.

As clearly illustrated in FIG. 3, a dispensing opening 10 is provided in a lateral portion of the collar 7 of the cover 4 which can be pivoted out of the closure ring 2. The dispensing opening 10 may be composed of several bores. In the embodiment illustrated in FIG. 3, two bores are provided. The number and size of the bores, and thus, the entire cross-section of the dispensing opening 10 can be selected as desired and can be determined by the herb or spice or the like to be filled into the container 1. It is emphasized once again in this connection that the dispensing opening 10 is provided only in the portion of the collar 7 which can be pivoted out of the closure ring 2. In order to limit this pivoting range, it is possible, on the one hand, to provide locking projections in the container 1 and recesses for the locking projections in the collar 7. Such locking projections and recesses for receiving the locking projection are illustrated in FIG. 6 of the drawing. The locking projections and recesses serve to secure the cover 4 in its normal position as well as in its pivoted positions. If necessary, it is also possible to provide limiting stops, not shown, in the container 1 or in the closure ring 2.

It is basically possible to provide an additional dispensing opening on the side of the collar 7 opposite the dispensing opening 10, wherein, however, the additional dispensing opening has a different cross-section and/or a different configuration from the dispensing opening 10 shown in FIG. 3. This makes it possible to provide, for example, dispensing openings 10 of different sizes in two oppositely directed pivoted positions of the cover 4, as shown in FIG. 6. In addition, it is possible to move the cover 4 in two steps into the pivoted position illustrated in FIG. 3. Thus, for example, in a first position determined, for example, by a locking projection and recess, only one row of bores of the dispensing opening 10 is released, while both rows of bores are free in the illustrated end position. This embodiment makes it possible, for example, to make available four differently sized dispensing openings 10. If desired, even more dispensing openings may be provided.

In order to be able to determine whether the filled device has or has not been used prior to being purchased and, thus, whether the contents of the device have been manipulated, it is possible to provide the device with a means for securing originality. Such a means may be composed, for example, of at least one welding point which connects the cover 4 to the closure ring 2 and can be destroyed by a slight application of force. Alternatively, it is also possible to provide a seal which is tight with respect to aroma and/or moisture and which can be ripped open. In addition, it is possible to provide on the outer surface of the cover 4 and/or in the opening 3 of the closure ring 2 a circumferentially extending sealing member which, for example, may be integrally connected to the cover 4 and/or to the closure ring 2. A separate arrangement of a sealing means is also conceivable. The use of a sealing member is advantageous in all those cases in which the cover 4 and the closure ring 2 are of materials which do not permit a tight sealing action with respect to moisture and/or aroma between the cover 4 and the cover ring 2.

Finally, it is pointed out that, depending on the configuration of the dispensing opening 10, the device according to the present invention can also be used for containing and dispensing leaf-like bulk materials, such as, tea, and for containing and dispensing tablets. If required, a special proportioning or metering chamber, not shown, may be provided in the interior of the cover 4, so that a proportioned dispensing of the contents, for example, sugar, is possible. It is also possible to manufacture the container 1 with the closure ring 2 and the cover 4 of one piece of synthetic material, wherein the cover 4 is connected to the closure ring 2 through a film hinge which can be torn later. Finally, it is also within the scope of the present invention to provide the dispensing opening 10 in the closure ring 2.

FIG. 4 of the drawing shows the closure ring 2 on a larger scale and FIG. 5 of the drawing shows the closure 4 to be inserted in the closure ring 2.

As shown in FIG. 5, the pin 8 has a trapezoidally-shaped projection. When the pin 8 is received in the opening 9, the side surfaces of the trapezoidally-shaped projection serve as stops for the pivoting movement of the cover.

FIG. 5 further shows a sealing ring 11 for guiding the cover 4 in a sealing manner in the closure ring 2.

While specific embodiments of the invention have been shown and described in detail to illustrate the inventive principles, it will be understood that the invention may be embodied otherwise without departing from such principles.

I claim:

1. A device for containing and dispensing pourable bulk materials, the device comprising a cup-shaped container, a closure ring integrally connected to the cup-shaped container, the closure ring defining an opening, a cover comprising an upper wall and a circumferentially extending collar connected to the upper wall, the cover defining a plurality of dispensing openings, pins defining a common axis attached to the cover, the closure ring having recesses, the pins being received in the recesses, the cover and the opening of the closure ring having a shape of a section of a laterally flattened body of rotation such that a cross-section of the cover coincides with a cross-section of the container, wherein the cover is guided in the opening of the closure ring in a positively engaging and sealing manner, and wherein the cover is pivotable within the opening of the closure ring between a normal position in alignment with the closure ring into two opposite directions into pivoted positions for releasing the dispensing openings and further into a position in which the opening of the closure ring is essentially completely released.

2. The device according to claim 1, comprising a sealing member mounted on one of the cover and the opening of the closure ring.

3. The device according to claim 1, wherein wherein the cover can be pivoted between a position in which some of the dispensing openings are released and a position in which all of the dispensing openings are released.

4. The device according to claim 3, comprising means for locking the cover in each position.

5. A device for containing and dispensing pourable bulk materials, the device comprising a cup-shaped container, a closure ring integrally connected to the cup-shaped container, the closure ring defining an opening, a cover comprising an upper wall and a circumferentially extending collar connected to the upper wall, the cover defining a plurality of dispensing openings, pins defining a common axis attached to the closure ring, the cover having recesses, the pins being received in the recesses, the cover and the opening of the closure ring having a shape of a section of a laterally flattened body of rotation such that a cross-section of the cover coincides with a cross-section of the container, wherein the cover is guided in the opening of the closure ring in a positively engaging and sealing manner, and wherein the cover is pivotable within the opening of the closure ring between a normal position in alignment with the closure ring into two opposite directions into pivoted positions for releasing the dispensing openings and further into a position in which the opening of the closure ring is essentially completely released.

* * * * *